United States Patent [19]

Rave

[11] 4,158,595

[45] * Jun. 19, 1979

[54] PREPARATION OF HYDROPHILIC STYRENE MALEIC ANHYDRIDE COPOLYMER FIBERS FOR USE IN PAPERMAKING

[75] Inventor: Terence W. Rave, Wilmington, Del.

[73] Assignee: Hercules Incorporated, Wilmington, Del.

[ * ] Notice: The portion of the term of this patent subsequent to May 15, 1996, has been disclaimed.

[21] Appl. No.: 819,427

[22] Filed: Jul. 27, 1977

[51] Int. Cl.[2] ..... D21H 5/12

[52] U.S. Cl. ..... 162/157 R; 162/146; 162/164 R; 162/164 EP; 162/168 R; 162/168 N; 162/168 NA; 162/182; 427/221; 427/444; 428/394; 428/395

[58] Field of Search ..... 260/29.2 EP, 29.2 N, 260/29.6 H, 29.6 NR; 428/394, 395; 427/444, 221; 162/146, 157 R, 164 EP, 164 R, 166, 168 N, 168 R, 168 NA, 182

[56] References Cited

U.S. PATENT DOCUMENTS

| | | | |
|---|---|---|---|
| 3,288,770 | 11/1966 | Butler | 260/88.3 |
| 3,403,113 | 9/1968 | Diethelm et al. | 260/2 |
| 3,556,932 | 1/1971 | Coscia et al. | 162/164 R |
| 3,677,888 | 7/1972 | Economou | 162/168 NA |
| 3,686,109 | 8/1972 | Aldrich et al. | 260/29.6 NR |
| 3,743,570 | 7/1973 | Yang et al. | 162/157 R |
| 3,816,556 | 6/1974 | Coscia et al. | 162/168 NA |
| 3,951,921 | 4/1976 | Espy et al. | 162/168 N |

FOREIGN PATENT DOCUMENTS 2413922 10/1974 Fed. Rep. of Germany.

*Primary Examiner*—S. Leon Bashore
*Assistant Examiner*—Peter Chin
*Attorney, Agent, or Firm*—John W. Whitson

[57] ABSTRACT

Hydrophilic fibers may be prepared by discharging a heated and pressurized dispersion of a styrene-maleic anhydride copolymer into a zone of reduced temperature and pressure, and then modifying the fibers so produced by treatment with an aqueous admixture of selected cationic and anionic water-soluble, nitrogen-containing polymers. Blends of the hydrophilic fibers with wood pulp provide paper products having improved physical properties.

11 Claims, No Drawings

PREPARATION OF HYDROPHILIC STYRENE MALEIC ANHYDRIDE COPOLYMER FIBERS FOR USE IN PAPERMAKING

This invention relates to a process for the preparation of hydrophilic synthetic polymer fibers which are readily dispersible in water and which can be blended with wood pulp fibers to provide a pulp which can be made into high quality paper using conventional papermaking techniques. More particularly, the invention relates to the formation of fibers from a styrene-maleic anhydride copolymer and treatment of these fibers with blends of certain water-soluble, nitrogen-containing polymers, one of which is cationic and the other of which is anionic.

In recent years, a considerable amount of effort has been expended in the development of fibrous synthetic pulps having hydrophilic properties. Much of the effort has been with polyolefins. For example, according to U.S. Pat. No. 3,743,570 to Yang et al, assigned to Crown Zellerbach Corporation, polyolefin fibers having a high surface area are treated with a hydrophilic colloidal polymeric additive composed of a cationic polymer such as melamineformaldehyde and an anionic polymer such as carboxymethyl cellulose. Hydrophilic polyolefin pulps also have been prepared by dispersing a polyolefin and a hydrophilic additive, such as polyvinyl alcohol or a hydrophilic clay, in a liquid which is not a solvent for either component at its normal boiling point, heating the resulting dispersion at superatmospheric pressure to dissolve the polymer and any solvent-soluble additive, and the spurting the resulting composition into a zone of reduced temperature and pressure to form a fibrous product. Using the spurting procedure, Toray Industries Inc. have disclosed in their German application No. 413,922, filed Mar. 22, 1974 and published Oct. 17, 1974 as No. 2,413,922, the preparation of anionic pulps from mixtures of polyolefins and copolymers of olefinic compounds with maleic anhydride or acrylic or methacrylic acids. Blends of these pulps with wood pulp have provided paper with better tensile strength than paper made without the copolymer component.

Now in accordance with this invention, it has been found that paper having further improved dry-strength properties can be prepared by forming a spurted fibrous anionic pulp from a styrene-maleic anhydride copolymer and then modifying this fibrous product by stirring a suspension of the fibers in a dilute aqueous solution or dispersion of a blend of a certain type of cationic, water-soluble, nitrogen-containing polymer and a certain type of anionic, water-soluble, nitrogen-containing polymer. The fiber modifying step of the process of this invention results in deposition of the blend of cationic and anionic nitrogen-containing polymers on the spurted fibers, and the originally anionic fibers are converted into modified fibers which are capable of bonding to the cellulosic fibers of wood pulp. It is a significant feature of the process of this invention that the cationic nitrogen-containing polymer used in the fiber modifying step of the process is one which imparts no substantial amount of wet strength to the paper product and thus permits the reworking of broke readily to take place.

As an example of the process of this invention, a styrene-maleic anhydride copolymer is dispersed in a mixture of hexane and water, and the dispersion is heated in a closed system to a temperature of about 220° C. Under these conditions, the pressure generated by the hexane and water vapors is of the order of 500 p.s.i. After introducing nitrogen to increase the vapor pressure of the system to a pressure of about 1000 p.s.i., the contents of the system are vented to the atmosphere through an orifice, resulting in evaporation of the water and the hexane solvent and formation of the fiber product. The fiber product then is suspended in an aqueous medium formed by blending a dilute aqueous solution of, for example, the reaction product of ammonia with epichlorohydrin-modified poly(diethylenetriamine-adipic acid) with a dilute aqueous solution of, for example, glyoxal-modified poly(acrylamide-co-acrylic acid), and the components of the resulting suspension are brought into intimate contact with each other by stirring. The treated fibers may then be isolated and stored in wet cake form, or the suspension containing the fibers may be used directly in a papermaking process.

Having generally outlined the embodiments of this invention, the following examples constitute specific illustrations thereof. All amounts are based on parts by weight.

EXAMPLE A

A cationic, water-soluble, nitrogen-containing polymer was prepared from diethylenetriamine, adipic acid, epichlorohydrin and ammonia. Diethylenetriamine in the amount of 0.97 mole was added to a reaction vessel equipped with a mechanical stirrer, a thermometer and a reflux condenser. There then was gradually added to the reaction vessel one mole of adipic acid with stirring. After the acid had dissolved in the amine, the reaction mixture was heated to 170°–175° C. and held at that temperature for one and one-half hours, at which time the reaction mixture had become very viscous. The reaction mixture then was cooled to 140° C., and sufficient water was added to provide the resulting polyamide solution with a solids content of about 50%. A sample of the polyamide isolated from this solution was found to have a reduced specific viscosity of 0.155 deciliters per gram when measured at a concentration of two percent in a one molar aqueous solution of ammonium chloride.

The polyamide solution was diluted to 13.5% solids and heated to 40° C., and epichlorohydrin was slowly added in an amount corresponding to 1.32 moles per mole of secondary amine in the polyamide. The reaction mixture then was heated at a temperature between 70° and 75° C. until it attained a Gardner viscosity of E–F. Sufficient water next was added to provide a solids content of about 12.5%, and the solution was cooled to 25° C. The pH of the solution then was adjusted to 4.7 with concentrated sulfuric acid. The resulting solution contained 12.5% solids and had a Gardner viscosity of B–C, and 80 parts of this solution was diluted to 10% solids with 20 parts of water. After adding sufficient sodium hydroxide to adjust the pH of the solution to 7, the solution was combined with 18.7 parts of concentrated (28%) aqueous ammonia and heated under reflux at 80°–85° C. for two hours. The resulting solution contained 10.1% solids.

EXAMPLE B

Another representative cationic, water-soluble, nitrogen-containing polymer was prepared, this time using diethylenetriamine, dicyandiamide and epichlorohydrin as the reactants. Diethylenetriamine in the amount of 206.4 parts was added to a reaction vessel equipped with a mechanical stirrer, a thermometer and a reflux condenser. There then was gradually added to the reaction vessel 165 parts of dicyandiamide with stirring. The reaction mixture was slowly heated to 130° C., at which point ammonia was vigorously evolved and the temperature of the reaction mixture exothermically rose to 160° C. After holding the temperature at 160° C. for three hours, the reaction mixture was cooled and diluted by the addition of sufficient water to provide the resulting suspension of the condensate product with a solids content of 58.8%.

Eighty-five parts of the above suspension was diluted with water to a solids content of 25% and added to a reaction vessel equipped with a mechanical stirrer, a thermometer and a reflux condenser. After heating the mixture to 60° C., with stirring, 35.5 parts of epichlorohydrin was slowly added to the reaction vessel, maintaining the temperature at 60° C. The reaction mixture was maintained at about 60° C. until a Gardner-Holdt viscosity of N was reached, at which point 200 parts of water was added to terminate the reaction. After adjusting the pH of the solution to 5 by the addition of formic acid, the solids content was 19.4%.

EXAMPLE C

Another representative cationic, water-soluble, nitrogen-containing polymer was prepared from methacryloyloxyethyltrimethylammonium methylsulfate. Twenty parts of this ammonium compound was dissolved in 175 parts of water, and to the resulting solution was added 0.04 part of copper sulfate. The solution was heated to 70° C. while being sparged with nitrogen. At this point, there was added to the solution 0.2 part of ammonium persulfate dissolved in 4.4 parts of water, and heating of the solution was continued for one hour. The resulting solution of poly(methacryloyloxyethyltrimethylammonium methylsulfate) contained 20% solids and had a Brookfield viscosity of 72 centipoises at 21° C.

EXAMPLE D

An anionic, water-soluble, nitrogen-containing polymer was prepared from acrylamide, acrylic acid and glyoxal. To a reaction vessel equipped with a mechanical stirrer, a thermometer, a reflux condenser and a nitrogen adapter was added 890 parts of water. There then was dissolved in the water 98 parts of acrylamide, two parts of acrylic acid and one and one-half parts of aqueous 10% cupric sulfate. The resulting solution was sparged with nitrogen and heated to 76° C., at which point two parts of ammonium persulfate dissolved in six and one-half parts of water was added. The temperature of the reaction mixture increased 21.5° C. over a period of three minutes following addition of the persulfate. When the temperature returned to 76° C., it was maintained there for two hours, after which the reaction mixture was cooled to room temperature. The resulting solution had a Brookfield viscosity of 54 centipoises at 21° C. and contained less than 0.2% acrylamide based on the polymer content.

To 766.9 parts of the above solution (76.7 parts of polymer containing 75.2 parts, or 1.06 mole, of amide repeat units) was added 39.1 parts of aqueous 40% glyoxal (15.64 parts, or 0.255 equivalent based on amide repeat units, of glyoxal). The pH of the resulting solution was adjusted to 9.25 by the addition of 111.3 parts of aqueous 2% sodium hydroxide. Within approximately 20 minutes after addition of the sodium hydroxide, the Gardner viscosity of the solution had increased from A to E. The reaction was then terminated by the addition of 2777 parts of water and about two and six-tenths parts of aqueous 40% sulfuric acid. The resulting solution had a pH of 4.4 and contained 2.2% solids.

EXAMPLE E

Another representative anionic, water-soluble, nitrogen-containing polymer was prepared using only acrylamide and glyoxal as reactants. In a reaction vessel equipped with a stirrer, a thermometer and a reflux condenser, there was placed 350 parts of acrylamide, one part of phenyl-β-naphthylamine and 3870 parts of chlorobenzene. This mixture was heated to 80° to 90° C. with vigorous stirring to partially melt and partially dissolve the acrylamide. One part of sodium hydroxide flake then was added to the mixture and, after an induction period, an exothermic reaction occurred and there was separation of polymer on the stirrer and on the walls of the reaction vessel. Three more one-part charges of sodium hydroxide flake were added to the reaction mixture at thirty-minute intervals, following which the reaction mixture was heated at about 90° C. for one hour. The hot chlorobenzene then was decanted, and the residual solid, a branched, water-soluble poly(β-alanine), was washed three times with acetone and subsequently dissolved at room temperature in 1000 parts of water. The cloudy solution so obtained, having a pH of about 10.5, was heated at about 75° C. for about 30 minutes to effect partial hydrolysis of the amide groups in the poly(β-alanine), and live steam was blown through the solution until the residual chlorobenzene had been removed and the last traces of polymer had dissolved. After cooling, the solution was adjusted to a pH of about 5.5 with sulfuric acid. The dissolved polymer contained about two mole percent carboxyl groups, as determined by potentiometric titration.

To an aqueous 15% solution of the above polymer was added an aqueous 40% solution of glyoxal in an amount sufficient to provide 25 mole percent of glyoxal based on the amide repeat units in the polymer. The pH of the resulting solution was slowly raised to about 9.0 to 9.5 at room temperature by the addition of dilute aqueous sodium hydroxide, and the pH was maintained at this level until an increase in Gardner viscosity of five to six units had occurred. The solution then was quickly diluted with water to 10% total solids and adjusted to a pH of 5.0 with sulfuric acid.

EXAMPLE 1

One hundred parts of a styrene-maleic anhydride copolymer (Arco/Polymers, Inc., 92:8 styrene:maleic anhydride, molecular weight 220,000) was charged to a closed autoclave along with 250 parts of hexane and 250 parts of water. The contents of the autoclave were stirred and heated to 220° C., at which point the vapor pressure in the autoclave was raised to 1000 p.s.i. by the introduction of nitrogen. The resulting emulsion was spurted from the autoclave into the atmosphere through an orifice having a diameter of one millimeter and a length of one millimeter, resulting in formation of the desired fiber product, which then was disc refined for six minutes in a Sprout Waldron disc refiner at 1.5% consistency in water.

Thirty parts of the refined pulp was blended with 70 parts of bleached kraft wood pulp (50:50 RBK:WBK, 500 Canadian Standard Freeness), and to portions of the resulting blend in papermaking crocks was added five percent, based on the refined pulp content of the blend, of (a) a blend of Kymene® 557 (cationic polymer formed by reaction of epichlorohydrin with the aminopolyamide derived from adipic acid and diethylenetriamine) with an anionic polymer prepared according to Example D, the ratio of cationic:anionic being 1:5 by weight, (b) a blend of a cationic polymer prepared according to Example A with an anionic polymer prepared according to Example D, the cationic:anionic ratio being 1:5 by weight, (c) a blend of a cationic polymer prepared according to Example B with an anionic polymer prepared according to Example D, the ratio of cationic:anionic being 1:5 by weight, (d) a blend of a cationic polymer prepared according to Example C with an anionic polymer prepared according to Example D, the ratio of cationic:anionic being 1:5 by weight, and (e) a blend of poly(diallyldimethylammonium chloride) (Merck Conductive Polymer 261, 40.85% solids, pH 2.8, viscosity 8060 as read on a Brookfield No. 3 spindle) with an anionic polymer prepared according to Example D, the ratio of cationic:anionic being 1:5 by weight. After thorough mixing of the additives with the pulp, handsheets were prepared and dried and calendered at 500 lbs./linear inch at 60° C.

The brightness, opacity, tensile strength and Mullen burst strength of the calendered sheets were determined, and the results are given in Table 1. In the data given in this table, the tensile strength and Mullen burst strength values are expressed as a percentage of the tensile strength and Mullen burst strength of the 100% wood pulp control, all being corrected to a 40 pound per ream basis weight.

Table 1

| Additive | Brightness (%) | Opacity (%) | Tensile Strength (%) | Mullen Burst Strength (%) |
|---|---|---|---|---|
| (a) | 88 | 90 | 88 | 85 |
| (b) | 89 | 90 | 85 | 83 |
| (c) | 89 | 90 | 90 | 87 |
| (d) | 90 | 90 | 83 | |
| (e) | 89 | 90 | 87 | 84 |

Broke reworkability studies made at a pH of 10 and a temperature of 150° F. showed that the paper made using additives (b), (c), (d) and (e) were adequately repulped after five minutes and were completely repulped after 10 minutes. In comparison, the paper made using additive (a) required 15 minutes for adequate repulping and 30 minutes for complete repulping. These studies were carried out in a standard TAPPI disintegrator, as described in TAPPI Method T 205 os-71, operating at 2800 r.p.m. and using one-inch squares of paper at a consistency of 1.33%.

EXAMPLE 2

The procedure of Example 1 was followed, using as the additives (a) a blend of Kymene® 557 with an anionic polymer prepared according to Example E, the ratio of cationic:anionic being 1:3 by weight, and (b) a blend of a cationic polymer prepared according to Example B with an anionic polymer prepared according to Example E, the ratio of cationic:anionic being 1:3 by weight. The data obtained from evaluating the resulting handsheets are given in Table 2.

Table 2

| Additive | Brightness (%) | Opacity (%) | Tensile Strength (%) | Mullen Burst Strength (%) |
|---|---|---|---|---|
| (a) | 89 | 90 | 90 | 88 |
| (b) | 89 | 90 | 89 | 86 |

Broke reworkability studies carried out as in Example 1 showed that the paper made using additive (b) was adequately repulped after five minutes and completely repulped after 10 minutes, whereas the paper made using additive (a) required 10 minutes for adequate repulping and 20 minutes for complete repulping.

EXAMPLE 3

The procedure of Example 1 was repeated except for use of 1:1 ratios of cationic:anionic polymer in blends (a), (b), (c) and (d) and use of an anionic polymer prepared according to Example D, but containing five percent acrylic acid. The results obtained are shown in Table 3.

Table 3

| Additive | Tensile Strength | Mullen Burst Strength | Reworkability (minutes) | |
|---|---|---|---|---|
| | | | Adequate | Complete |
| (a) | 90 | 92 | 15 | 30 |
| (b) | 91 | 90 | 5 | 10 |
| (c) | 94 | 93 | 5 | 10 |
| (d) | 89 | 87 | <5 | 5 |

The brightness and opacity of the handsheets were essentially the same as those of Example 1.

Example 4

The fiber preparation of Example 1 was duplicated except for use of a styrene-maleic anhydride copolymer in which the styrene:maleic anhydride ratio was 4:1. The fiber product was disc refined at one percent consistency in water for six minutes in a Sprout Waldron disc refiner. The procedure of Example 1 then was further followed in blending the refined pulp with wood pulp, treating the resulting pulp with blends of cationic and anionic polymers, forming handsheets and determining their properties. The cationic:anionic polymer blends (a), (b), (c) and (d) of Example 1 were used except for the modification of having a cationic:anionic ratio of 1:1 and using as the anionic polymer one prepared according to Example D, but containing 10% acrylic acid. The data so obtained are given in Table 4.

Table 4

| Additive | Tensile Strength | Mullen Burst Strength | Reworkability (minutes) | |
|---|---|---|---|---|
| | | | Adequate | Complete |
| (a) | 94 | 90 | 20 | 40 |
| (b) | 92 | 89 | 10 | 15 |
| (c) | 91 | 92 | 10 | 15 |
| (d) | 90 | 88 | 5 | 10 |

The anionic pulp used in the process of this invention is prepared by spurting certain copolymers of styrene and maleic anhydride. These copolymers obviously must have fiber-forming properties, consequently the preferred copolymers are those having a molecular weight in the range of from about 10,000 to about 300,000, preferably from about 50,000 to about 200,000. The styrene-maleic anhydride copolymers also must contain sufficient carboxylic functionality to render the corresponding fibers hydrophilic and to be effective with the blend of cationic and anionic water-soluble, nitrogen-containing polymers used to modify the fibers. Accordingly, the ratio of styrene to maleic anhydride in the copolymers may be in the range of from about 96:4 to about 75:25, preferably from about 94:6 to about 90:10. Processes for preparing these copolymers are well known in the art.

The dispersing medium used in the fiber-forming step of the process of this invention contains an organic solvent which is a nonsolvent at its normal boiling point for the styrene-maleic anhydride used to form the fibers. It may be the hexane shown in the examples, or other aliphatic hydrocarbons such as butane, pentane, heptane, octane and their isomers. Also useful are aromatic hydrocarbons such as benzene, toluene and xylene; alicyclic hydrocarbons such as cyclohexane; and halogenated hydrocarbons such as methylene chloride, chloroform, carbon tetrachloride, methyl chloride, ethyl chloride, trichlorofluoromethane and 1,1,2-trichloro-1,2,2-trifluoroethane. Mixtures of these solvents may be used, and water desirably is present to form an emulsion of the copolymer. The pressure generated by the solvent and water vapors may be, and normally will be, augmented by a pressurized inert gas such as nitrogen or carbon dioxide.

In carrying out the fiber-forming process, the concentration of the styrene-maleic anhydride copolymer in dispersion in the dispersing medium normally will be from about 5 to about 40% by weight, preferably from about 10 to about 30% by weight. The temperature to which the dispersion of the copolymer is heated will generally be in the range of from about 100° to about 225° C. The pressure on the dispersion of the copolymer may be from about 500 to about 1500 p.s.i., but preferably is in the range of from about 900 to about 1200 p.s.i. The orifice through which the copolymer composition is discharged should have a diameter of from about 0.5 to about 15 mm., preferably from about one to about five mm., and the ratio of the length of the orifice to its diameter should be from about 0.2 to about 10.

In the fiber-modifying step of the process of this invention, the fibers of the fibrous styrene-maleic anhydride copolymer composition are suspended in a dilute aqueous admixture of certain cationic and anionic nitrogen-containing polymers and the suspension is stirred, resulting in the deposition on the fibers of from about one to about 15% by weight of the admixture, based on the weight of the fibrous composition. The ratio of the cationic to the anionic polymer in the admixture of these polymers preferably is in the range of from about 3:1 to about 1:5 by weight, more preferably from about 1:1 to about 1:3 by weight. A preferred type of cationic polymer component of the aforementioned admixture is one which is derived from a polymer containing secondary or tertiary amine groups, or both. One representative group of polymers belonging to this type may be exemplified by a cationic polymer component used in many of the examples, namely, the reaction product of ammonia with the epichlorohydrin-modified aminopolyamide derived from diethylenetriamine and adipic acid. Preparation of this product is shown in Example A. However, more generally, this group of cationic polymers are the reaction products of ammonia or lower alkyl amines with epichlorohydrin-modified aminopolyamides derived from a dicarboxylic acid and a polyalkylenepolyamine having two primary amine groups and at least one secondary or tertiary amine group.

Particularly suitable dicarboxylic acids for preparation of the aminopolyamides are diglycolic acid and saturated aliphatic dicarboxylic acids containing from 3 through 10 carbon atoms such as malonic acid, succinic acid, glutaric acid, adipic acid, pimelic acid, suberic acid, azelaic acid, and sebacic acid. Other suitable dicarboxylic acids include terephthalic acid, isophthalic acid, phthalic acid, maleic acid, fumaric acid, itaconic acid, glutaconic acid, citraconic acid, and mesaconic acid. The available anhydrides of the above acids can be used in preparing the water-soluble aminopolyamide as well as the esters of the acids. Mixtures of two or more dicarboxylic acids, their anhydrides, and their esters can be used to prepare the water-soluble aminopolyamides, if desired.

A number of polyalkylene polyamines, including polyethylene polyamines, polypropylene polyamines, polybutylene polyamines and the like can be employed in preparation of the aminopolyamides. Polyalkylene polyamines can be represented as polyamines in which the nitrogen atoms are linked together by groups of the formula $-C_nH_{2n}-$ where n is a small integer greater than unity and the number of such groups in the molecule ranges from two up to about eight. The nitrogen atoms can be attached to adjacent carbon atoms in the group $-C_nH_{2n}-$ or to carbon atoms farther apart, but not to the same carbon atom. Polyamines such as diethylenetriamine, triethylenetetramine, tetraethylenepentamine, and dipropylenetriamine, which can be obtained in reasonably pure form are suitable for preparing water-soluble aminopolyamides. Other polyalkylene polyamines that can be used include methyl bis(3-aminopropyl)amine; methyl bis(2-aminoethyl)amine; and 4,7-dimethyltriethylenetetramine. Mixtures of polyalkylene polyamines can be used, if desired.

The spacing of an amino group on the aminopolyamide can be increased if desired. This can be accomplished by substituting a diamine such as ethylenediamine, propylenediamine, hexamethylenediamine and the like for a portion of the polyalkylene polyamine. For this purpose, up to about 80% of the polyalkylene polyamine can be replaced by a molecularly equivalent amount of diamine. Usually, a replacement of about 50% or less will be adequate.

The temperatures employed for carrying out the reaction between the dicarboxylic acid and the polyalkylenepolyamine may vary from about 110° C. to about 225° C. or higher at atmospheric pressure. For most purposes, however, temperatures between about 160° C. and 210° C. have been found satisfactory and are preferred. Where reduced pressures are employed, somewhat lower temperatures may be utilized. The time of reaction depends on the temperatures and pressures utilized and will ordinarily vary from about one-half to two hours, although shorter or longer reaction times may be utilized depending on reaction conditions. In any event, the reaction is desirably continued to substantial completion for best results.

In carrying out the reaction, it is preferred to use an amount of dicarboxylic acid sufficient to react substantially completely with the primary amine groups of the polyalkylene polyamine but insufficient to react with the secondary and/or tertiary amine groups to any substantial extent. This will usually require a mole ratio of polyalkylenepolyamine to dicarboxylic acid of from about 0.9:1 to about 1.2:1. However, mole ratios of from about 0.8:1 to about 1.4:1 may be used with quite satisfactory results. Mole ratios outside of these ranges are generally unsatisfactory. Thus, mole ratios below about 0.8:1 result in a gelled product or one having a pronounced tendency to gel while mole ratios above 1.4:1 result in low molecular weight polyamides.

In converting the aminopolyamide, formed as above described, to a cationic resin, it is reacted with epichlorohydrin at a temperature from about 45° C. to about 100° C. and preferably between about 45° C. and 70° C. until the viscosity of a 20% solids solution at 25° C. has reached about C or higher on the Gardner scale. This reaction is preferably carried out in aqueous solution to moderate the reaction. pH adjustment is usually not necessary. However, since the pH decreases during the polymerization phase of the reaction, it may be desirable, in some cases, to add alkali to combine with at least some of the acid formed.

When the desired viscosity is reached, sufficient water is then added to adjust the solids content of the resin solution to the desired amount, i.e., about 10% more or less, the product cooled to about 25° C. and the product then may be stabilized by adding sufficient acid to reduce the pH at least to about 6 and preferably to about 5. Any suitable acid such as hydrochloric, sulfuric, nitric, formic, phosphoric and acetic acid may be used to stabilize the product. However, sulfuric acid is preferred.

In the aminopolyamide-epichlorohydrin reaction, it is preferred to use sufficient epichlorohydrin to convert all secondary amine groups to tertiary amine groups. However, more or less may be added to moderate or increase reaction rates. In general, satisfactory results may be obtained utilizing from about 0.5 mole to about 1.8 moles of epichlorohydrin for each secondary or tertiary amine group of the aminopolyamide. It is preferred to utilize from about 1.0 mole to about 1.5 moles for each secondary amine group of the aminopolyamide.

The reaction of ammonia or a lower alkyl amine with the epichlorohydrin-modified aminopolyamide to produce a cationic polymer component useful in accordance with this invention preferably is carried out in an aqueous medium, which can be the same as that containing the epichlorohydrin-modified aminopolyamide. However, since the reaction with ammonia or the amine requires a pH of 7 or above, it may be necessary first of all to adjust the pH of the polymer solution, desirably by adding an alkali metal hydroxide such as sodium hydroxide. Moreover, for the reaction with ammonia or the amine, the solids content of the polymer solution should be in the range of from about one to about 25% by weight, preferably from about six to about 15%. The reaction is carried out at a temperature in the range of from about 0° to about 150° C., preferably from about 50° to about 100° C. Pressures greater than atmospheric may be used, if desired, particularly at temperatures above the boiling point of the reaction mixture.

The lower alkyl amines useful in the above reaction may be any primary, secondary or tertiary alkyl amine containing one to four carbon atoms in each of the alkyl radicals. Representative of such amines are methylamine, dimethylamine, trimethylamine and the corresponding ethyl-, propyl-, isopropyl-, butyl- and isobutyl-amines, as well as t-butylamine and di-t-butylamine. Also useful are the amines containing different $C_1$–$C_4$ alkyl groups in the molecule, for example, N-ethyl-N-methylpropylamine, N,N-dimethylethylamine, N,N-diethylpropylamine, N-ethyl-N-propyl-t-butylamine, N-methylpropylamine and N-ethylbutylamine.

The amount of ammonia or lower alkyl amine used in the reaction with the epichlorohydrin-modified aminopolyamide should be at least stoichiometrically equivalent to the amount of epoxide groups introduced into the aminopolyamide in its reaction with epichlorohydrin. Complete reaction with all of the epoxide groups is necessary to avoid gelation, consequently, it is desirable to use a substantial excess of ammonia or the amine. Any unreacted ammonia or amine can be permitted to remain in the reaction product or can be removed, as by heating under atmospheric or reduced pressure, and recovered for further use.

Another representative group of polymers belonging to the preferred type of cationic polymers is that wherein the polymers are the water-soluble reaction products of epichlorohydrin and the condensates of a polyalkylene polyamine with cyanamide or dicyandiamide. The preparation of an exemplary product from this group is shown in Example B. The polyalkylene polyamines which can be reacted with cyanamide or dicyandiamide have the formula $H_2N(C_nH_{2n}NH)_xH$ wherein n is an integer 2 through 8 and x is an integer 2 or more, preferably 2 through 6. Examples of such polyalkylene polyamines are the polyethylene polyamines, polypropylene polyamines and polybutylene polyamines. Specific examples of these polyalkylene polyamines include diethylenetriamine, triethylenetetramine, tetraethylenepentamine, bis(hexamethylene)triamine and dipropylenetriamine. Other polyalkylene polyamines that can be used include methyl bis(3-aminopropyl)amine; methyl bis(2-aminoethyl)amine; and 4,7-dimethyltriethylenetetramine. Mixtures of polyalkylene polyamines can be used if desired. The relative proportions of polyalkylene polyamine and cyanamide or dicyandiamide will vary depending upon the particular polyalkylene polyamine used. In general, however, there is used from about 0.1 to about 1.0 mole of dicyandiamide for every equivalent of primary amine groups in the polyalkylene polyamine. For example, diethylenetriamine will require from about 0.2 to about 2.0 moles of dicyandiamide. In any given case, the amount of cyanamide, when used, will be twice the amount of dicyandiamide.

The condensation of the polyalkylene polyamine with cyanamide or dicyandiamide is carried out by heating the reactants at a temperature in the range of from about 100° to about 200° C., preferably from about 130° to about 160° C. Generally, it is not necessary to use a solvent, but if one is desired, the mono- or di-alkyl ethers of ethylene glycol or diethyleneglycol are suitable. During the reaction, ammonia is evolved. Upon completion of the reaction, the reaction mixture is diluted with water to a solids content of, for example, about 25%, and the resulting product is suitable for reaction with epichlorohydrin to provide a water-soluble, cationic polymer useful in accordance with this invention. The reaction with epichlorohydrin generally is carried out under conditions similar to those already described for preparation of the epichlorohydrin-modified aminopolyamides.

Another group of preferred cationic polymers useful in accordance with this invention is that in which the polymers are poly(diallyldialkylammonium chloride)s. These are linear polymers having units of the formula:

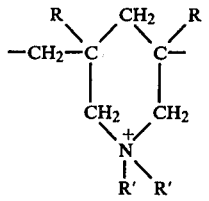

where R is hydrogen or lower alkyl and R′ is alkyl or a substituted alkyl group. Polymers having units of the above formula are obtained by polymerizing quaternary ammonium chloride salt monomers in which the quaternary ammonium cation is represented by the formula:

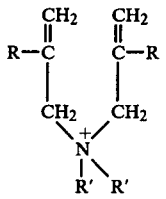

in which R and R′ are as indicated above, in the presence of a free radical catalyst.

In both of the above formulae, each R can be the same or different, and, as stated, can be hydrogen or lower alkyl. The alkyl groups may contain from 1 to 4 carbons and are preferably methyl, ethyl, isopropyl or n-butyl. R′ of the formulae represents alkyl or substituted alkyl groups. The R′ alkyl groups may contain from 1 to 18 carbon atoms, preferably from 1 to 6 carbon atoms, such as methyl, ethyl, propyl, isopropyl, butyl, tert-butyl, hexyl, octyl, decyl, dodecyl, tetradecyl, and octadecyl. R′ may also be a substituted alkyl group. Suitable substituents include, in general, any group which will not interfere with polymerization through a vinyl double bond. Typically, the substituents may be carboxylate, cyano, ether or amido.

The monomers used in preparing the above polymers can themselves be prepared, for example, by the reaction of a primary amine with an allyl halide to produce the corresponding tertiary amine, followed by quaternization of the latter with an alkyl chloride. Thus, for example, diallyldimethylammonium chloride can be prepared by reaction of two moles of an allyl halide, such as allyl chloride, with one mole of methylamine to form N-methyldiallylamine hydrochloride, which then is quaternized with methyl chloride.

In preparing the diallyldialkylammonium chloride polymers, the polymerization reaction can be initiated by a redox catalyst system. In a redox system, the catalyst is activated by means of a reducing agent such as sodium metabisulfite or potassium metabisulfite, or by means of a reducing salt such as ferrous sulfate. The use of a redox initiator system has several advantages, the most important of which is efficient polymerization at lower temperatures. Conventional peroxide catalysts such as tertiary-butyl hydroperoxide, potassium persulfate, hydrogen peroxide and ammonium persulfate are used in conjunction with the above reducing agents. The polymerization generally is carried out in a solvent, preferably water, at a temperature of from about 0° to about 100° C., preferably from about 25° to about 75° C. Instead of water, solvents such as ethanol, dioxane, dimethylformamide or acetonitrile also may be used. The concentration of the monomer in the solvent may be from about 10 to about 75%, preferably from about 25 to about 60%.

A final group of effective cationic polymers useful in accordance with this invention is that in which the polymers are homopolymers, or certain copolymers, of acrylate and methacrylate alkyl esters containing quaternary ammonium groups. The preparation of an exemplary product from this group of cationic polymers is shown in Example C. The alkylene group in these compounds preferably contains two to four carbon atoms, as in, for example, β-methacryloyloxyethyldimethylbenzylammonium chloride and (acryloyloxy-n-butyldiethylmethylammonium methyl sulfate. Other representative monomers are acryloyloxyethyltrimethylammonium methyl sulfate, β-methacryloyloxyethyltrimethylammonium, β-methacryloyloxyethyldiethylmethylammonium methyl sulfate and β-methacryloyloxyethyldiethylmethylammonium chloride. These monomers all contain quaternary ammoniun groups having three alkyl substituents, each of which contains one or two carbon atoms.

Any of the foregoing monomers may be copolymerized with an acrylamide having the formula

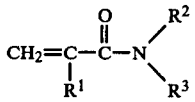

wherein $R^1$, $R^2$ and $R^3$ may each be hydrogen or a lower alkyl group having one to four carbon atoms. Representative compounds of the above formula are acrylamide, methacrylamide and N-isopropylacrylamide, with acrylamide being preferred. The acrylamide monomers may be used in amounts up to about 75 mole percent when copolymerized with the acrylate and methacrylate esters containing quaternary ammonium groups. Processes for carrying out the polymerizations here involved are well known in the art.

The polymers which are useful as the anionic polymer component of the aqueous solution or dispersion in which the fibers of the fibrous styrene-maleic anhydride copolymer composition are modified also have been illustrated in the examples. One of these is the reaction product of glyoxal and the polyacrylamide obtained by copolymerization of acrylamide with acrylic acid. The preparation of an exemplary product is shown in Example D. The amount of acrylic acid units in the copolymer may be from about two to about 15%. Comparable products can be prepared by partial hydrolysis of polyacrylamide or a poly(acrylamide-co-alkyl acrylate) such as a copolymer of acrylamide with ethyl acrylate. Any of these polyacrylamides can be prepared by conventional methods for the polymerization of water-soluble monomers and preferably have molecular weights less than about 25,000, for example, in the range of from about 10,000 to about 20,000.

The other anionic, nitrogen-containing polymer shown in the examples is the reaction product of glyoxal and the polymer obtained by partial hydrolysis of a branched, water-soluble poly(β-alanine). Preparation of a representative product is shown in Example E. The poly(β-alanine) is prepared by the anionic polymerization of acrylamine in the presence of a basic catalyst and a vinyl or free-radical polymerization inhibitor, and the polymer will have a molecular weight in the range of from about 500 to about 10,000, preferably from about 2000 to about 6000. Because of the extremely exothermic nature of the anionic polymerization, it is preferred to conduct the reaction in a suitable organic reaction medium inert to the reaction conditions and capable of dissolving or slurrying acrylamide. Suitable media include aromatic and aliphatic compounds, for example, toluene, xylene, tetrahydronaphthalene, chlorobenzene, nitrobenzene and dioxane. The concentration of the acrylamide monomer in the reaction medium is in the range of from about two to about 30%, and is preferably from about eight to about 15%. If desired, an organosoluble polymeric dispersing agent can be added to the reaction mixture prior to the addition of the basic catalyst. When the dispersing agent is employed, the poly(β-alanine) produced is in powdered or bead form, easily filterable from the reaction medium. Suitable dispersing agents are styrene-butadiene copolymers, polyisoprene, chlorinated polypropylene, chlorinated and maleated polyisoprene and chlorinated and maleated polyolefins.

Illustrative basic catalysts which can be employed include alkali metals, alkali metal hydroxides, alkaline earth metal hydroxides, quaternary ammonium hydroxides and the alkali metal alkoxides. Specific examples of suitable basic catalysts are sodium, sodium hydroxide, lithium hydroxide, potassium hydroxide, sodium t-butoxide, sodium methoxide, tetramethylammonium hydroxide, potassium t-butoxide and calcium hydroxide. The amount of catalyst used is in the range of about 0.01 to about 2.0 mole %, preferably about 0.1 to about 1.5 mole %, based on the monomer. A free radical inhibitor is added to the reaction mixture to inhibit vinyl polymerization through the double bond of the acrylamide monomer. Examples of free radical inhibitors which can be used are phenyl-β-naphthylamine, hydroquinone, diphenylamine and phenothiazine. The polymerization reaction is conducted at temperatures in the range of from about 40° to about 140° C. and preferably from about 80° to about 130° C. In some cases, the anionic polymerization of acrylamide under the preceding conditions will produce a mixture of water-soluble and water-insoluble poly(β-alanine). The water-soluble polymer can be readily separated by partially dissolving the polymer product in water and removing the insoluble fraction by conventional methods such as filtration.

The branched poly(β-alanine) produced as described above is a neutral polymer and needs to be anionically modified for the purpose of this invention. Anionic modification of branched poly(β-alanine) can be accomplished by partial hydrolysis of the polymer to convert some of the primary amide groups into anionic carboxyl groups. For example, hydrolysis of poly(β-alanine) can take place by heating a slightly basic aqueous solution of the polymer having a pH of about 9 to 10 at temperatures of about 50° to about 100° C. The amount of anionic groups introduced should be from about one to about ten mole percent, and preferably about two to about five mole percent, based on amide repeating units.

Each of the anionic, nitrogen-containing polymers described above is modified with glyoxal to provide the desired anionic, water-soluble, nitrogen-containing polymers used in accordance with this invention. The reaction with glyoxal is carried out in a dilute neutral or slightly alkaline aqueous solution of the polymer at a temperature of from about 10° to about 50° C., preferably from about 20° to about 30° C. The concentration of the polymer in the solution may be from about five to about 40% by weight, but preferably is from about seven to about 20%. The amount of glyoxal used in the reaction mixture may be from about 10 to about 100 mole percent, preferably from about 20 to about 30 mole percent, based on amide repeat units in the polymer. The reaction is allowed to continue until a viscosity increase of from about two to about ten, preferably from about four to about six, units on the Gardner scale has taken place. This increase in viscosity is indicative that some crosslinking of the polymer has desirably taken place, but this amount of crosslinking is insufficient to cause gelation. The reaction then is terminated, usually by dilution of the reaction mixture with water and addition of sulfuric acid to lower the pH to about 4.5–5.0. The resulting solutions possess good stability.

The process of this invention makes possible the preparation of improved paper products from blends of wood pulp and styrene-maleic anhydride copolymer pulps. The process depends upon the particular combination of cationic and anionic nitrogen-containing polymers used in the fiber-modifying step, and the particular cationic polymers used provide the additional advantage of facile broke reworking. Moreover, the process depends upon several critical factors, namely, a molecular weight of at least 10,000 for the styrene-maleic anhydride copolymer, sufficient available carboxyl in the copolymer and sufficient resin in the aqueous solution or dispersion in which the anionic copolymer fibers are modified. However, operation within the limits of these conditions makes it possible to produce a synthetic pulp which, when blended with wood pulp, will provide a paper product having at least 80% of the tensile strength of 100% wood pulp, as well as improved brightness, opacity smoothness and printability at low sheet weights compared with conventional filled or unfilled paper.

What I claim and desire to protect by Letters Patent is:

1. A process for the preparation of a fibrous pulp containing hydrophilic synthetic polymer fibers which comprises stirring a suspension of the fibers of a spurted fibrous styrene-maleic anhydride copolymer composition in a dilute aqueous admixture of water-soluble nitrogen-containing cationic and anionic polymers, said cationic polymer being (a) the reaction product of ammonia or a lower alkyl amine and an epichlorohydrin-modified aminopolyamide derived from a dicarboxylic acid and a polyalkylene polyamine having two primary amine groups and at least one secondary or tertiary amine group, or (b) the reaction product of epichlorohydrin and a condensate of cyanamide or dicyandiamide with a polyalkylene polyamine having the formula $H_2N(C_nH_{2n}NH)_xH$, wherein n is an integer 2 through 8 and x is an integer 2 or more, or (c) a poly(diallyldialkylammonium chloride) or (d) a poly(acrylate or methacrylate alkyl ester containing quaternary ammonium groups), and said anionic polymer being the reaction product of glyoxal and (a) a polyacrylamide containing from about 2 to about 15% acrylic acid units or (b) a partially hydrolyzed, branched poly(β-alanine) containing from about 1 to about 10 mole percent carboxyl groups based on amide repeating units, the ratio of said cationic polymer to said anionic polymer in said admixture of said polymers being in the range of from about 3:1 to about 1:5 by weight and the amount of said admixture of said polymers deposited on the fibers of said fibrous composition being from about one to about 15% by weight based on said fibrous composition.

2. The process of claim 1 wherein the spurted fibrous styrene-maleic anhydride copolymer has a styrene to maleic anhydride ratio which is in the range of from about 96:4 to about 75:25.

3. The process of claim 1 wherein the spurted fibrous styrene-maleic anhydride copolymer has a molecular weight in the range of from about 10,000 to about 300,000.

4. The process of claim 1 wherein the cationic, water-soluble, nitrogen-containing polymer is the reaction product of ammonia or a lower alkyl amine and an epichlorohydrin-modified aminopolyamide derived from a dicarboxylic acid and a polyalkylene polyamine having two primary amine groups and at least one secondary or tertiary amine group.

5. The process of claim 4 wherein the aminopolyamide is derived from adipic acid and diethylenetriamine.

6. The process of claim 5 wherein the anionic, water-soluble, nitrogen-containing polymer is the reaction product of glyoxal and the polyacrylamide obtained by copolymerization of acrylamide with acrylic acid.

7. The process of claim 5 wherein the anionic, water-soluble, nitrogen-containing polymer is the reaction product of glyoxal and the polymer obtained by partial hydrolysis of a branched, water-soluble poly($\beta$-alanine).

8. The aqueous fibrous pulp suspension produced by the process of claim 1.

9. A paper product prepared from the acqueous fibrous pulp suspension of claim 8.

10. The process of claim 1 wherein the hydrophilic synthetic fibers are separated from said aqueous suspension thereof.

11. The hydrophilic synthetic fibers produced by the process of claim 10.

* * * * *

UNITED STATES PATENT AND TRADEMARK OFFICE

CERTIFICATE OF CORRECTION

PATENT NO. : 4,158,595

DATED : June 19, 1979

INVENTOR(S) : Terence W. Rave

It is certified that error appears in the above-identified patent and that said Letters Patent are hereby corrected as shown below:

Table I reads:

| Additive | Brightness (%) | Opacity (%) | Tensile Strength (%) | Mullen Burst Strength (%) |
|---|---|---|---|---|
| (d) | 90 | 90 | 83 | |

Should read:

| Additive | Brightness (%) | Opacity (%) | Tensile Strength (%) | Mullen Burst Strength (%) |
|---|---|---|---|---|
| (d) | 90 | 91 | 84 | 83 |

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*